US008704194B2

(12) United States Patent
Komatsu et al.

(10) Patent No.: US 8,704,194 B2
(45) Date of Patent: Apr. 22, 2014

(54) INFORMATION ACQUIRING APPARATUS AND INFORMATION ACQUIRING METHOD FOR ACQUIRING MASS-RELATED INFORMATION

(75) Inventors: Manabu Komatsu, Kawasaki (JP); Hiroyuki Hashimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/083,510

(22) Filed: Apr. 8, 2011

(65) Prior Publication Data

US 2011/0248156 A1 Oct. 13, 2011

(30) Foreign Application Priority Data

Apr. 12, 2010 (JP) ..... 2010-091468

(51) Int. Cl.
*H01J 49/14* (2006.01)
*H01J 49/10* (2006.01)

(52) U.S. Cl.
USPC ..... 250/425; 250/288; 250/282

(58) Field of Classification Search
USPC ..... 250/281, 282, 283, 286, 287, 288, 250/423 R, 424, 425
See application file for complete search history.

(56) References Cited

U.S. PATENT DOCUMENTS

| | | | | |
|---|---|---|---|---|
| 5,164,594 | A * | 11/1992 | Thompson et al. | 250/288 |
| 6,121,608 | A | 9/2000 | Takada et al. | 250/288 |
| 6,204,500 | B1 * | 3/2001 | Whitehouse et al. | 250/287 |
| 7,605,003 | B2 * | 10/2009 | Chan et al. | 436/178 |
| 7,701,138 | B2 | 4/2010 | Hashimoto et al. | 313/564 |
| 2005/0194544 | A1 * | 9/2005 | Vestal et al. | 250/425 |
| 2006/0192104 | A1 * | 8/2006 | Schultz et al. | 250/287 |
| 2009/0242751 | A1 * | 10/2009 | Gabeler | 250/282 |
| 2010/0227308 | A1 | 9/2010 | Hashimoto et al. | 435/4 |
| 2011/0210243 | A1 * | 9/2011 | Colby et al. | 250/282 |

FOREIGN PATENT DOCUMENTS

| | | |
|---|---|---|
| JP | 8-145950 | 6/1996 |
| JP | 9-320515 | 12/1997 |

* cited by examiner

*Primary Examiner* — David A Vanore
*Assistant Examiner* — Wyatt Stoffa
(74) *Attorney, Agent, or Firm* — Fitzpatrick, Cella, Harper & Scinto

(57) ABSTRACT

Target molecules in a sample can be detected at an improved sensitivity by means of a mass spectrometer. A sample with or without a matrix is placed on a substrate and irradiated with a converged and pulsed primary beam selected from an ion beam, a neutral particle beam or a laser beam. Secondary ions and neutral molecules are emitted along with protons from the irradiated point of the sample as an electric field is applied between the substrate and an extraction electrode disposed above the substrate. A proton-control electrode is arranged in axial symmetry with the trajectory of the primary beam. A voltage is applied thereto so that the generated electric field decelerates the flying protons to raise their adhering efficiency to the flying neutral molecules.

11 Claims, 5 Drawing Sheets

INFORMATION ACQUIRING APPARATUS AND INFORMATION ACQUIRING METHOD FOR ACQUIRING MASS-RELATED INFORMATION

BACKGROUND OF THE INVENTION

1. Field of the Invention

The present invention relates to an information acquiring apparatus and an information acquiring method for acquiring mass-related information.

2. Description of the Related Art

For the use with the matrix assisted laser desorption/ionization time-of-flight mass spectrometry (MALDI-TOFMS), a solid or liquid sample is mixed with a substance that is referred to as matrix (e.g., sinapinic acid, glycerin and like others) and applied onto a metal-made sample holder. Then, the sample holder carrying the matrix containing the sample is introduced into a vacuum chamber. As a laser beam is irradiated as a primary probe onto the matrix, while a high voltage is being applied between the sample holder and an extraction electrode that is arranged above the sample holder, ingredients of the matrix absorb the laser energy to be gasified and emitted with molecules of the sample into the vacuum from the sample holder. In the course of this process, molecules of the sample are believed to be ionized as protons are transferred between molecules of the matrix and those of the sample to form secondary ions. The secondary ions that are formed in this way are then accelerated by the extraction electrode and the mass/charge ratio of the secondary ions can be determined by observing the time-of-flight of the secondary ions until they get to a detector.

On the other hand, the time-of-flight secondary ion mass spectrometry (TOF-SIMS) utilizes the same principle except that it differs from the MALDI-TOFMS in that the former does not use any matrix and its primary probe is different from that of the MALDI. With the TOF-SIMS, a sample holder on which a sample is arranged is introduced into vacuum and a primary ion beam is irradiated as a primary probe onto the sample, while a high voltage is being applied between the sample holder and an extraction electrode that is arranged above the sample holder. Then, in the course of this process, molecules of the sample are believed to be ionized as protons are transferred from the moisture or an organic ingredient contained in the sample to form secondary ions. The secondary ions that are formed in this way are then accelerated by the extraction electrode and the mass/charge ratio of the secondary ions can be determined by observing the time-of-flight of the secondary ions until they get to a detector. In the following, laser beams or primary ion beams as used in the above as a primary probe are referred to inclusively as "primary beam".

Ionized molecules of the sample are usually detected as protonated molecules of the sample (or in the state that sample molecules are adhered with other charged particles; the state nevertheless being represented by protonated molecules in the following description) produced by way of the above described process. However, many of the emitted sample molecules end up without colliding with protons in their flights and hence without participating the observation. Meanwhile, with the electro-spray ionization mass spectrometry (ESI-MS), the sensitivity of detecting molecules of a sample is believed to be improved by causing protons generated to a large extent from a solvent such as water to adhere to molecules of the sample. Therefore, an improvement of detection sensitivity can be expected for MALDI-TOFMS and also for TOF-SIMS by promoting adhesion of protons to emitted molecules of a sample. Japanese Patent Application Laid-Open No. H08-145950 discloses a method of improving the sensitivity of detecting molecules of a sample by way of a process that includes (1) gasifying an aqueous solution containing molecules of the sample, (2) exciting water molecules by a corona discharge to generate protons, and (3) causing generated protons to adhere to molecules of the sample. Japanese Patent Application Laid-Open No. H09-320515 discloses a method of improving the sensitivity of detecting specific sample molecules by arranging an ion-capturing electrode above a sample substrate (the ion-capturing electrode being insulated from the sample substrate) and causing an ionic chemical reaction to take place in a generated electric field.

With a method of analytically observing the mass of sample molecules on a substrate such as MALDI or TOF-SIMS, many of the sample molecules emitted from the sample fly in a neutral state. Thereafter, protons adhere to molecules of the sample and electrically charged secondary ions are detected as described above. At this time, since both protons and sample molecules divergently fly away from the point of irradiation of the primary beam, there arises a problem that protons adhere to sample molecules only with a low probability. The above-cited Japanese Patent Application Laid-Open No. H08-145950 discloses a method of supplying protons by means of a corona discharge in order to solve the problem.

However, the proposed method is accompanied by a problem of requiring a mechanism for supplying protons to make the overall mass spectrometer to be used for the method a complex and bulky one. Additionally, since protons are directly fed into a vacuum chamber with the proposed method, the chamber becomes full of protons to give rise to a high background level for signal detection. A high background level is detrimental to the reliability of observation.

The method described in the above cited Japanese Patent Application Laid-Open No. H09-320515 of improving the sensitivity of detecting specific sample molecules by arranging an ion-capturing electrode above a sample substrate and causing an ionic chemical reaction to take place in a generated electric field, on the other hand, is accompanied by the problems as listed below. The problems are: that (1) substances that can be made to become involved in an ionic chemical reaction by the proposed technique are electrically charged ions and the technique cannot handle neutral sample molecules; and that (2) protons are made to adhere to neutral sample molecules only poorly efficiently in "an electric field that is perpendicular to a sample substrate" generated by the electrode provided above the substrate. The reason for the problem (2) will be described in detail below. Firstly, the trajectory of a primary beam is defined as primary beam axis and the point of intersection of the primary beam axis and the sample surface is defined as central point. Furthermore, the axis that passes the central point and is normal relative to the substrate is defined as central axis. With these definitions, protons and sample molecules divergently fly away from the central point as described above. Many of those protons and sample molecules fly divergently from the central point into a conical region having a vertex at the central point and a rotation axis that is disposed in axial symmetry with the primary beam axis with regard to the central axis. Then, "an electric field that is perpendicular to a sample substrate" as described in Japanese Patent Application Laid-Open No. H09-320515 can hardly draw the protons that have flown away effectively back toward the sample substrate. In other words, the probability with which protons are made to adhere to flying sample molecules can hardly be raised.

SUMMARY OF THE INVENTION

As a result of intensive research efforts for solving the above-identified problems, the inventors of the present invention invented an apparatus and a method that can efficiently cause protons or other charged particles produced from a sample ingredient or a matrix to adhere to flying neutral sample molecules.

Thus, the present invention provides an information acquiring apparatus for acquiring information relating to the mass of a constituent of an object on a substrate by means of mass spectrometry, the apparatus comprising: a mechanism for converging and pulsing a primary beam selected from an ion beam, a neutral particle beam and a laser beam and irradiating the converged and pulsed primary beam onto the object on the substrate; a control electrode arranged in a conical region for applying a backward force to flying charged particles generated by the irradiation of the primary beam, the conical region having a vertex at a central point and a rotation axis disposed in axial symmetry with a primary beam axis with regard to a central axis and diverging from the vertex with an angle of 30° relative to the rotation axis, where the primary beam axis is a trajectory of the primary beam, the central point is a point of intersection of the trajectory of the primary beam and a surface of the object, and the central axis passes the central point and is disposed normal to the substrate; and an extraction electrode arranged above the substrate for mass spectrometry.

The present invention also provides an information acquiring method for acquiring information relating to the mass of a constituent of an object on a substrate by means of mass spectrometry, the method comprising steps of: converging and pulsing a primary beam selected from an ion beam, a neutral particle beam and a laser beam and irradiating the converged and pulsed primary beam onto the object on the substrate to drive neutral molecules of the constituent and charged particles to fly; applying a voltage to a control electrode to apply a backward force toward the object on the substrate to flying charged particles simultaneously with or after the irradiation of the converged and pulsed primary beam to make the flying charged particles adhere to flying neutral molecules of the constituent; and applying a voltage to the extraction electrode after applying a voltage to the control electrode to detect neutral molecules of the constituent with charged particles adhering thereto by means of a mass spectrometer to acquire mass information, the control electrode being arranged in a conical region, the conical region having a vertex at a central point and a rotation axis disposed in axial symmetry with a primary beam axis with regard to a central axis and diverging from the vertex with an angle of 30° relative to the rotation axis, where the primary beam axis is a trajectory of the primary beam, the central point is a point of intersection of the trajectory of the primary beam and a surface of the object, and the central axis passes the central point and is disposed normal to the substrate.

In a mode of carrying out the present invention, the control electrode is flat-panel-shaped, parabola-shaped or ring-shaped.

In a mode of carrying out the present invention, a DC voltage or an AC voltage with a frequency within a range between 0.1 and 10 MHz is applied to the control electrode such that an electric field having an intensity within a range between 1 kV/m and 20 kV/m as an average absolute value is generated between the control electrode and the object.

In a mode of carrying out the present invention, the information acquiring apparatus has a mechanism for controlling a timing of pulsing the primary beam, a timing of applying a voltage to the control electrode and a timing of applying a voltage to the extraction electrode.

In a mode of carrying out the present invention, the information acquiring apparatus controls a timing of applying a voltage to the extraction electrode such that it is between 0.1 μsec and 20 μsec after the primary beam gets to the object.

In a mode of carrying out the present invention, the information acquiring apparatus controls timings of applying a voltage to the control electrode and applying a voltage to the extraction electrode such that a voltage is applied to the control electrode simultaneously with or after the primary beam gets to the object and subsequently a voltage is applied to the extraction electrode.

In a mode of carrying out the present invention, the constituent is a protein, a peptide, a sugar chain, a polynucleotide or an oligonucleotide.

Further features of the present invention will become apparent from the following description of exemplary embodiments with reference to the attached drawings.

Preferred embodiments of the present invention will now be described in detail in accordance with the accompanying drawings.

DESCRIPTION OF THE EMBODIMENTS

Figure 1:
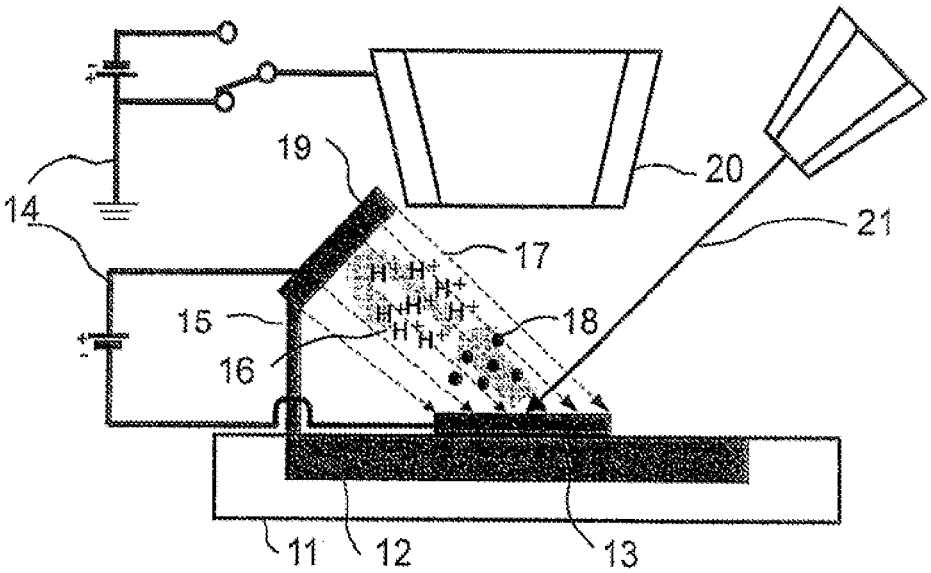
FIG. 1 is a schematic cross-sectional view illustrating the spatial positional relationship of the proton-control electrode, the primary beam, the substrate and the extraction electrode for mass spectrometry in an information acquiring apparatus according to the present invention.

FIG. 1 schematically illustrates an information acquiring apparatus according to the present invention. Referring to FIG. 1, information relating to the mass of a constituent of the object arranged on a substrate 13 is to be acquired by means of mass spectrometry. The object can be anything that can be observed by mass spectrometry. Examples that can be the object include high molecular compounds, low molecular compounds, organic compounds, inorganic compounds, living bodies, organs, samples originating from living bodies, tissue segments, cells and cultured cells. Examples that can be a constituent of an object include organic compounds, inorganic compounds, proteins, peptides, sugar chains, polynucleotides and oligonucleotides. While any mass spectrometry methods can be used for the purpose of the present invention, the use of a method that employs MALDI, SIMS or FAB (fast atom bombardment) for ionization and a time-of-flight type, magnetic reflection type, quadrupole type, ion trap type or Fourier transform ion cyclotron resonance type analyzer may be suitable. With such a mass spectrometry method, the signal intensity that is the value obtained by dividing the mass of the constituent by the electric charge thereof can be acquired as information relating to the mass. As illustrated in FIG. 1, an information acquiring apparatus according to the present invention includes a mechanism for irradiating a primary beam 21 onto an object on the substrate. Although not illustrated, the mechanism by turn includes a mechanism for converging and pulsing the primary beam. The primary beam may be an ion beam, a neutral particle beam or a laser beam.

As illustrated in FIG. 1, an information acquiring apparatus according to the present invention includes a control electrode 19 that is arranged in a conical region for applying a backward force to flying charged particles generated by the irradiation of the primary beam. The conical region has a vertex at a central point and a rotation axis disposed in axial symmetry with a primary beam axis with regard to a central axis and diverges from the vertex with an angle of 30° relative to the rotation axis, where the primary beam axis is a trajectory of the primary beam, the central point is a point of intersection of the trajectory of the primary beam and a surface of the object, and the central axis passes the central point and is disposed normal to the substrate. The information acquiring apparatus further includes an extraction electrode 20 for mass spectrometry above the substrate. Preferably, the control electrode is arranged on the rotation axis disposed in axial symmetry with the primary beam axis, since such arrangement is most effective for providing high detection sensitivity. The control electrode is an electrode that is installed for the purpose of generating an electric field and controlling protons or other charged particles. When charged particles such as protons are emitted from an object and driven to fly, the emission profile will show a distribution having a peak having some breadth at the direction in axial symmetry with the direction of the incident primary beam. If the control electrode is arranged in the conical region having a vertex at the central point and a rotation axis disposed in axial symmetry with the primary beam axis with regard to the central axis and diverging from the vertex with an angle of 30° relative to the rotation axis, a backward force toward the object on the substrate is applied effectively to the flying charged particles by applying a voltage between the substrate and the control electrode. In contrast, if the control electrode is arranged outside the conical region, such a backward force may not be applied effectively. Hence, when the control electrode is provided in the conical region, the collision between flying neutral molecules and flying charged particles generated by the irradiation with the primary beam will occur at a high probability and the detection sensitivity of the target constituent of the object will be improved. The control electrode may be flat-panel-shaped, parabola-shaped or ring-shaped. When a hollow electrode such as a ring-shaped electrode, the above requirement for arrangement may be satisfied by the electrode structure including the hollow portion. Preferably, the voltage applied to the control electrode 19 is a DC voltage or an AC voltage with a frequency found within a range between 0.1 and 10 MHz and the average absolute value of the intensity of the electric field generated between the control electrode 19 and the object is found within a range between 1 kV/m and 20 kV/m.

The information acquiring apparatus of the present invention has an extraction electrode 20 above the substrate for the purpose of accelerating ions in a mass spectrometry process.

Figure 6:
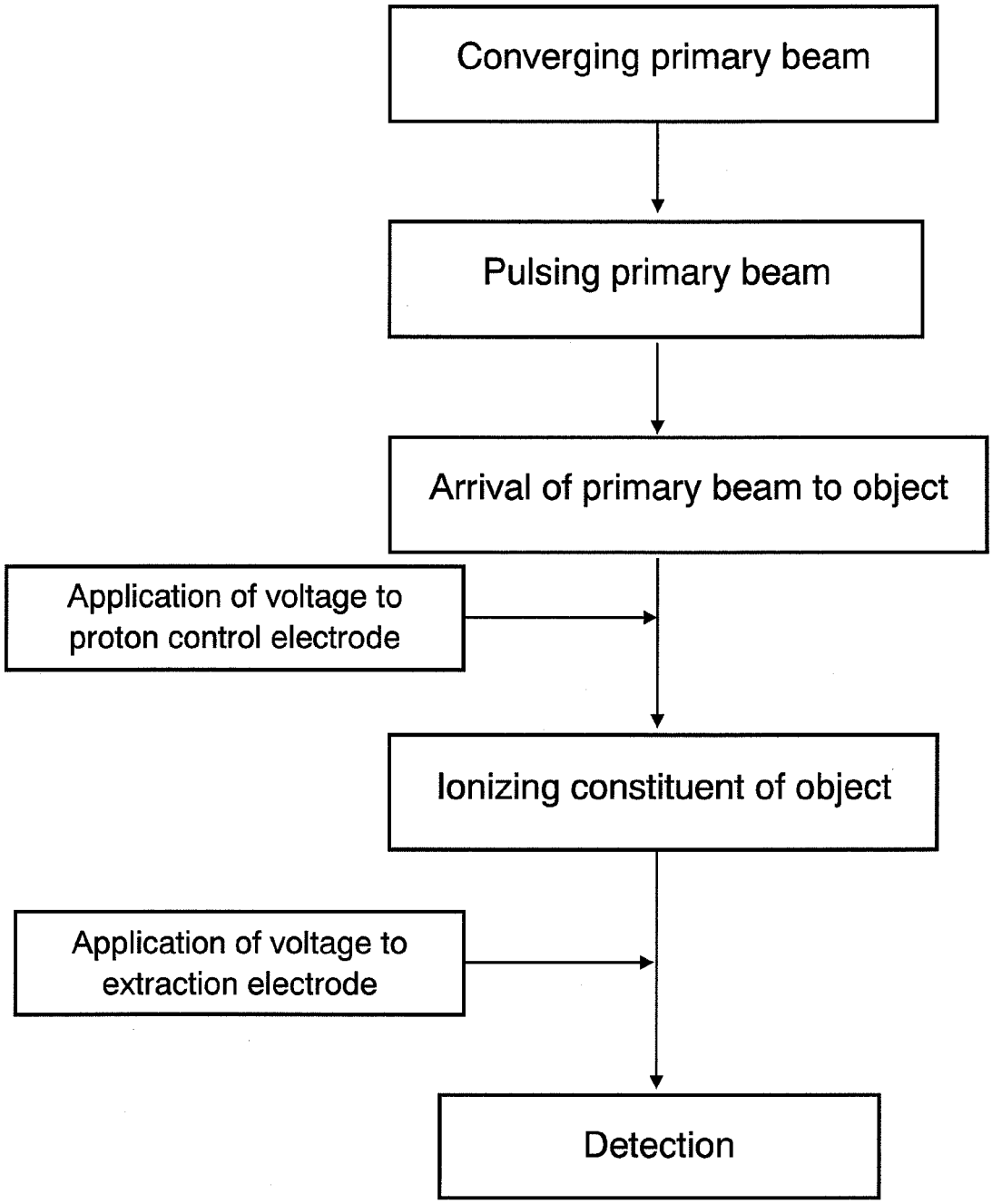
FIG. 6 is a flowchart illustrating exemplar control timings of an information acquiring apparatus according to the present invention.

Although not illustrated in the drawings, an information acquiring apparatus according to the present invention includes a mechanism for controlling the timing of pulsing the primary beam 21, the timing of applying a voltage to the control electrode 19 and the timing of applying a voltage to the extraction electrode 20. FIG. 6 schematically illustrates an example of controlling these timings. Provided that the timing at which the primary beam 21 gets to the object is defined as "time=0", the timing of applying a voltage to the extraction electrode 20 is preferably between 0.1 μsec and 20 μsec. Preferably, a voltage is applied to the control electrode simultaneously with or after the primary beam gets to the object and subsequently a voltage is applied to the extraction electrode.

Now, the present invention will be described in greater detail by way of an example and a comparative example. In the following examples, the term "proton-control electrode" is used instead of "control electrode" used in the above description, in view of the fact that protons are the typical charged particles. While the best mode of carrying out the present invention is illustrated in the example, the present invention is by no means limited to the example.

Example

Preparation of a Sample Holder Equipped with a Proton-Control Electrode

Figure 2:
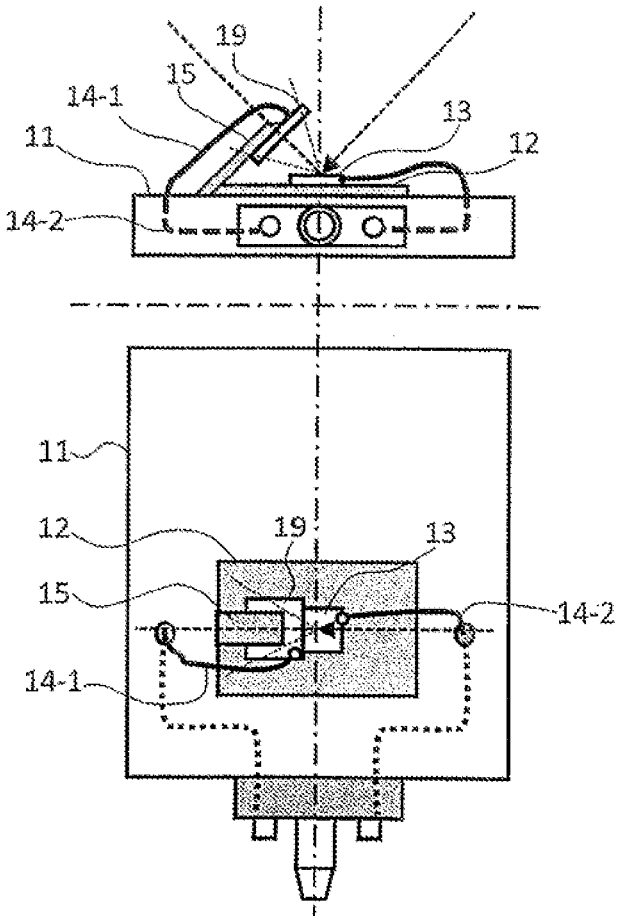
FIG. 2 is a schematic plan view and a schematic front view of a sample holder equipped with a proton-control electrode in an information acquiring apparatus according to the present invention.

A sample holder that was equipped with a proton-control electrode was prepared and fitted to a TOF-SIMS apparatus (available from ION-TOF). FIG. 2 illustrates a plan view and a front view of the sample holder 11 that was equipped with a proton-control electrode 19. Anode wiring 14-1 and cathode wiring 14-2 were arranged so as to allow a DC voltage of about ±200V to be applied externally and connected respectively to the proton-control electrode 19 and substrate 13 at the front ends thereof. The other ends of the wirings were connected to a regulated power supply unit that was arranged externally. The substrate 13 was covered by an insulator plate 12 in order to block leak currents.

The proton-control electrode 19 was rigidly secured to an insulator-supporter rod 15 and arranged at a position where flying protons 16 emitted to fly from the substrate 13 could be effectively captured. More specifically, in the case of a TOF-SIMS apparatus, since 45° oblique left relative to the normal to the substrate 13 illustrated in FIG. 2 becomes an incident direction of the primary beam 21, most protons 16 are emitted to fly in the direction of 45° oblique right relative to the normal to the substrate 13 illustrated in FIG. 2. Therefore, the proton-control electrode 19 was arranged in such a way that the center of the electrode was located on the axis extending in the direction of 45° oblique right relative to the normal to the substrate 13 as illustrated in FIG. 2.

The proton-control electrode 19 and the supporter rod 15 are desirably so adjusted in terms of size and level of arrangement that the generated ions may not be drawn away by the mass spectrometer 20 and that the proton-control electrode 19 may not be brought into contact with the mass spectrometer 20. In this example, the proton-control electrode 19 was so arranged that its central part was located 7 mm above the sample on the substrate. Then, the distance between the center of the sample and that of the proton-control electrode 19 was equal to 10 mm.

A 1 mm-thick Teflon™ sheet cut to 10 mm×10 mm was used as the insulator plate 12 and rigidly secured onto the sample holder 11 of this example by means of screws. Then, a substrate 13 formed from a gold-deposited silicon wafer by cutting the wafer to 2 mm×2 mm was rigidly secured onto the center of the insulator plate 12 by mean of a double stick tape. The proton-control electrode 19 was formed by cutting an aluminum foil to 5 mm×5 mm and fitted onto the top end of an insulator-supporter rod 15 prepared by cutting a cardboard to about 2 mm×10 mm by means of a double stick tape. The bottom end of the insulator-supporter rod 15 was rigidly secured to the insulator plate 12 on the sample holder.

The copper wire of the anode wiring 14-1 and that of the cathode wiring 14-2 were connected respectively to the rear surface of the proton-control electrode 19 and the substrate 13 and power was supplied to the external electrode current-introducing terminal arranged on the sample holder 11. The electric field distribution that was to be observed when a voltage was applied to the proton-control electrode 19 by using the wirings was computationally determined by means of the two-dimensional finite-difference time-domain method. FIG. 1 illustrates the direction of the line of electric force 17 that was to be observed. FIG. 1 also illustrates the behavior of protons 16 flying in the electric field.

[Acquisition of Information on an Organic Film Sample]

A 10 μg/mL aqueous solution of peptide molecules Neurotensin-I representing a mass number of 1672 (available from SIGMA) was prepared as sample to be observed. The solution was dropped by 0.5 μL on a gold-deposited/silicon substrate cut to 2 mm×2 mm and dried by blowing air in the atmosphere to produce the substrate 13. Subsequently, the substrate 13 was mounted on the sample holder 11 and observed by TOF-SIMS.

[Observation by TOF-SIMS]

A TOF-SIMS IV apparatus (tradename) available from ION-TOF was employed for the observation by TOF-SIMS.

Primary ions: 25 kV $Ga^+$, 2.4 pA (pulse current value), saw-tooth scan mode

Pulse frequency of primary ions: 5 kHz (200 μs/shot)

Primary ion pulse width: about 0.8 nsec

Primary ion beam diameter; about 0.8 μm

Observation area: 200 μm×200 μm

Secondary ion observation points: 128×128 points

Total time: 16 scans (about 52 sec)

Secondary ion extraction electrode voltage: 0 or −2 kV (switchable)

Distance between secondary ion extraction electrode and substrate: 1.5 mm

Secondary ion detection mode: positive ions

Voltage applied between proton-control electrode and substrate: +160 to −20 V(DC)

Figure 3A:
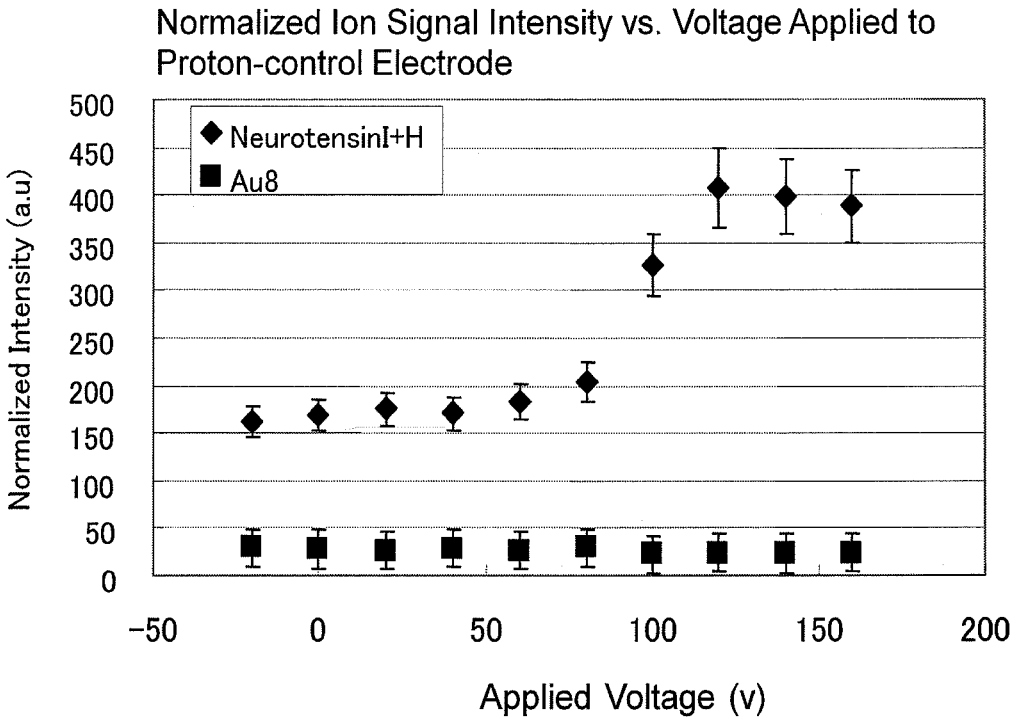
FIG. 3A is a graph illustrating the correlation between the voltage applied to the proton-control electrode and the normalized ion count of $[\text{Neurotensin}+H]^+$ and $Au_8^+$ in an example.
Figure 3B:
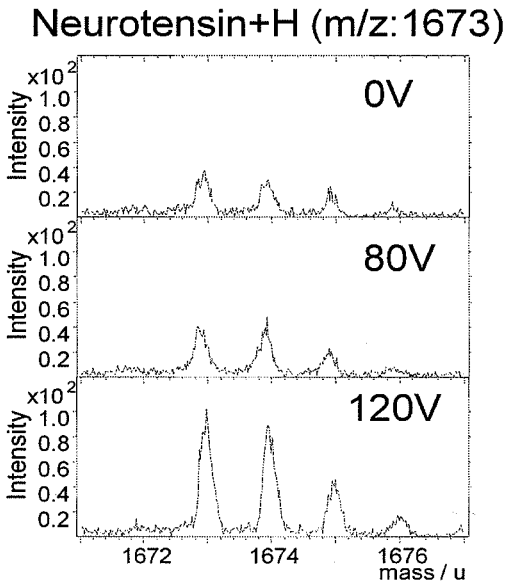
FIG. 3B and FIG. 3C are the spectrum of $[\text{Neurotensin}+H]^+$ and that of $Au_8^+$ observed when a typical voltage was applied between them.
Figure 3C:
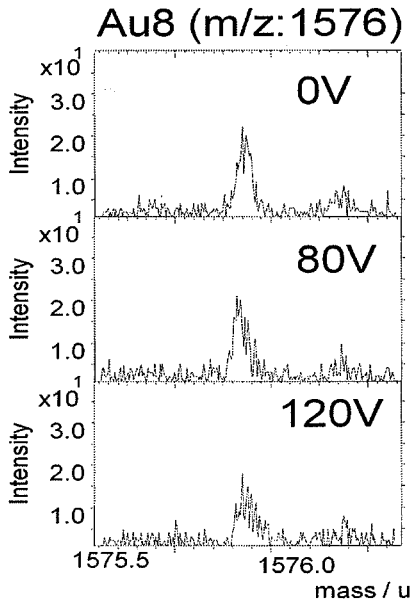

Duration of application of voltage between proton-control electrode and substrate: constant Delay time from arrival of primary ion beam at substrate to application of voltage to extraction electrode for secondary ion detection: about 0.5 μsec A TOF-SIMS observation was conducted under the above listed observation conditions. The voltage applied between the proton-control electrode 19 and the substrate 13 was changed from −20 to +160 with a step of 20 V for the observation without shifting the sample position. Thereafter, the observation point was shifted several times and a similar observation was repeated. The peak area intensity (ion count number) of sample molecules $[Neurotensin+H]^+$ (m/z=1673.2) and that of $Au_8^+$ (gold octamer ion; m/Z=1575.9) obtained in each of the observations were normalized by the respective total detected quantities (total ion counts) and were used as respective detected quantities. FIG. 3A is a graph obtained by plotting the average values of the obtained detected quantities against the above voltage values. Note that the voltage applied to the proton-control electrode corresponds to the voltage applied between the proton-control electrode 19 and the substrate 13. As seen from the graph, the detected quantity of $[Neurotensin+H]^+$ increases violently about when the voltage applied to the proton-control electrode rises above 100 V. This can be explained by an idea that (1) as the voltage that is being applied to the proton-control electrode rises, protons 16 emitted from the substrate 13 are drawn back in the direction opposite to the direction in which they started to fly so that (2) they will highly probably collide with neutral sample molecules 18 flying at lower speed and thus, as a result, protons satisfactorily adhere to sample molecules. On the other hand, no proton adheres to $Au_8^+$ ions by nature and hence the detection level of $Au_8^+$ ions will be substantially constant regardless of the value of the voltage applied to the proton-control electrode. The results illustrated in FIG. 3A can be supported by this idea.

Now, the behavior of protons that is observed at the time when a voltage is applied to the proton-control electrode will be discussed. The kinetic energy of a proton 16 emitted from the surface of a sample is known to be within a range between 1 and 30 eV when the sample is irradiated with a primary beam of TOF-SIMS. This can be found out with ease by means of the reflectron mechanism with which any TOF detector is equipped. As for the traveling time of a proton that is flying with kinetic energy of such a level in an electric field in vacuum, the proton will require about 0.1 to 2 seconds to make a round-trip in an electric field of 100 V/10 mm that is produced between the substrate 13 and the proton-control electrode of this example. When this is put together with the delay time of 0.5 μsec of voltage application to the extraction electrode for detecting secondary ions, a conclusion that can be drawn will be that (1) flying protons 16 cannot be caught and hence will collide with the proton-control electrode 19 when the voltage being applied to the proton-control electrode is not higher than 100 V and (2) conversely protons will increasingly adhere to sample molecules but generated ions will be pushed back toward the substrate 13 by a strong electric field to collide with the substrate 13 and lose their electric charges when the voltage being applied to the proton-control electrode is much higher than 100 V. In this example, the adhesion of protons to sample molecules progressed to improve the sensitivity of acquiring information within a range between 100 V and 160 V when a voltage is applied to the proton-control electrode.

To summarize the above, the sensitivity was not improved when the voltage applied to the proton-control electrode was lower than 100 V because protons did not adhere to sample molecules sufficiently but the adhesion of protons to sample molecules progressed when the voltage applied to the proton-control electrode was higher than 100 V. However, when the applied voltage is raised further, many of the generated ions will lose their electric charges for the above-described reason. The changes in the quantity of detected sample molecules with protons adhering thereto (the normalized ion count of $[Neurotensin+H]^+$) illustrated in the graph of FIG. 3A conceivably depict the above-described phenomenon.

Comparative Example

Figure 4:
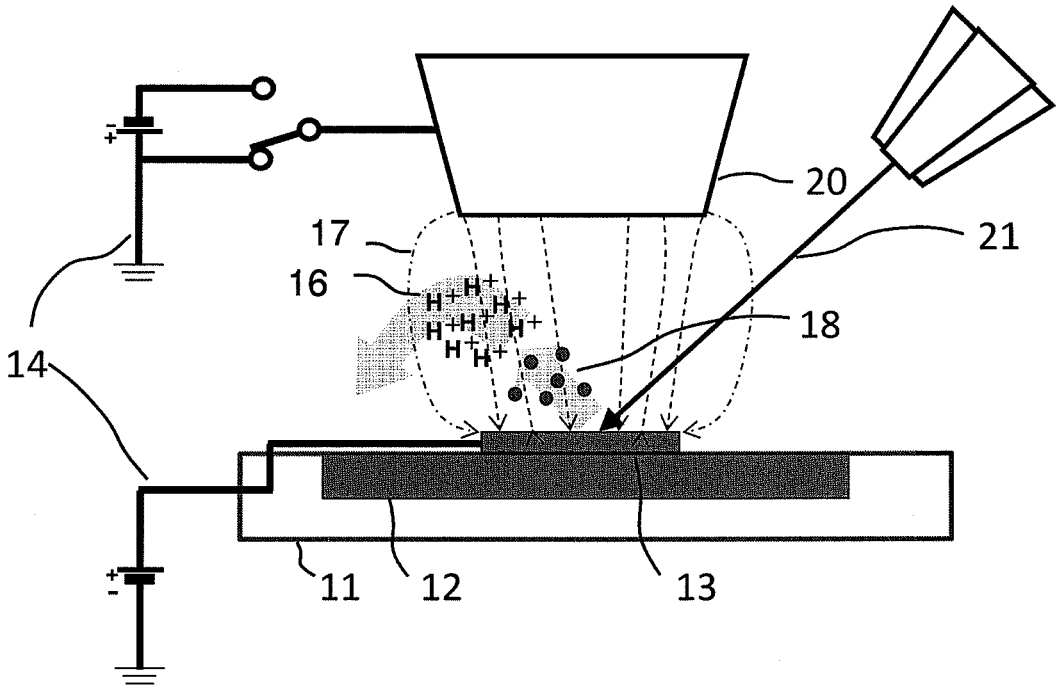
FIG. 4 is a schematic cross-sectional view illustrating the spatial positional relationship of the primary beam, the substrate and the extraction electrode for mass spectrometry in a comparative example.

In a comparative experiment, an electric field was applied in the direction perpendicular to substrate 13 to detect sample molecules. The sample holder 11 and the substrate 13 same as those of the above-described example were used. More specifically, the sample holder 11 was equipped with a proton-control electrode 19 and peptide molecules Neurotensin had been dropped on the substrate 13. However, in this comparative example, the anode wiring 14-1 was not connected to the proton-control electrode 19 and the other end of the cathode wiring 14-2 that was connected to the substrate 13 of the above-described example was connected to the sample holder 11 instead. With this arrangement, a voltage up to ±200 V can be applied in the direction perpendicular to the substrate 13 by using the sample biasing mechanism attached to the TOF-SIMS apparatus. The electric field generated by a voltage application, using the sample biasing mechanism, was computed by means of the two-dimensional FTDT method. In FIG. 4, the broken lines represent the directions of lines of electric force 17 of the generated electric field. As seen from FIG. 4, the electric field is applied to the substrate 13 in the direction perpendicular to the substrate. FIG. 4 also schematically illustrates the behaviors of protons 16 flying in the electric field. Thus, the electric field applied in the direction perpendicular to the substrate 13 was shifted by changing the sample bias voltage from 0 to −200 V in the comparative example.

Figure 5A:
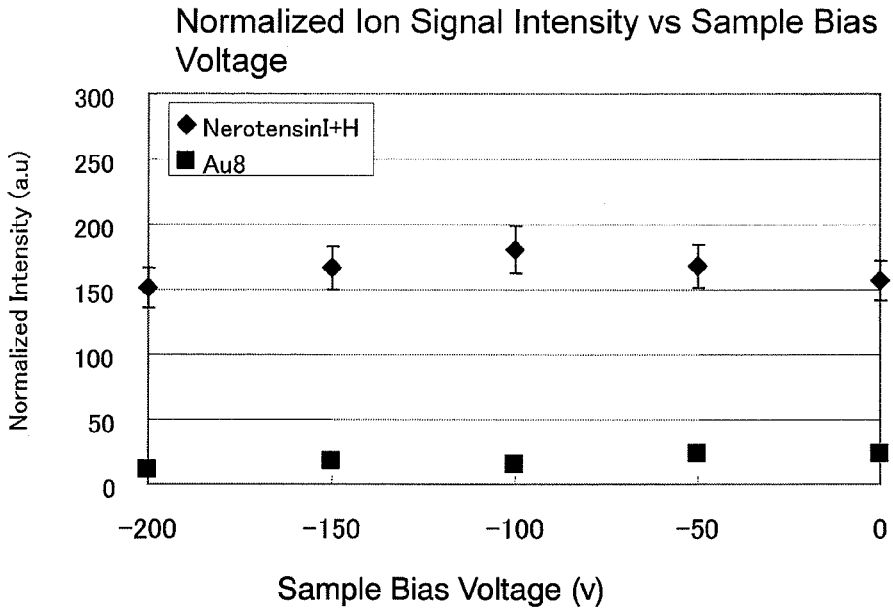
FIG. 5A is a graph illustrating the correlation between the voltage applied to the proton-control electrode and the normalized ion count of $[\text{Neurotensin}+H]^+$ and $Au_8^+$ in a comparative example.
Figure 5B:
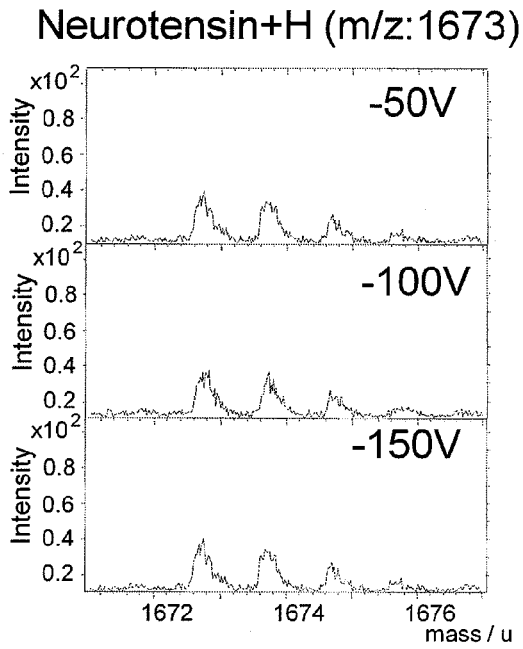
FIG. 5B and FIG. 5C are the spectrum of $[\text{Neurotensin}+H]^+$ and that of $Au_8^+$ observed when a typical voltage was applied between them.
Figure 5C:
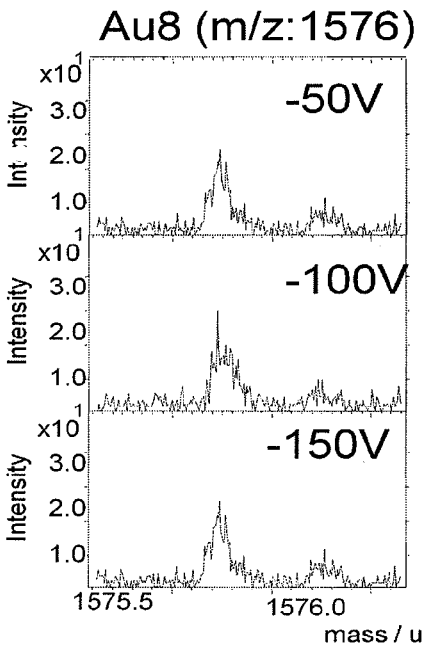

The detected quantity of $[\text{Neurotensin}+\text{H}]^+$ and that of $Au_8^+$ (the normalized ion counts) were observed under the conditions that were otherwise same as those of the above-described example. FIG. 5A is a graph illustrating the obtained results. As seen from the graph, both the detected quantity of $[\text{Neurotensin}+\text{H}]^+$ and that of $Au_8^+$ did not change remarkably with respect to the change of the sample bias voltage.

A conclusion that can safely be drawn from the result is that, when an electric field is applied in the direction perpendicular to substrate, protons 16 are also drawn back toward the substrate 13 but the probability at which protons 16 collide with neutral sample molecules 18 cannot be improved remarkably. As seen from the behaviors of protons 16 illustrated in FIG. 4, the adhesion of protons 16 to sample molecules cannot be made to progress satisfactorily when an electric field is applied in the direction perpendicular to the substrate so that consequently the detected quantity of $[\text{Neurotensin}+\text{H}]^+$ does not seem to change remarkably as illustrated in the graph of FIG. 5A.

(Evaluation)

As described above, the inventors of the present invention found that protons can be made to efficiently adhere to sample molecules by arranging a proton-control electrode 19 on a sample holder and applying an electric field between the electrode and the substrate 13 in a TOF-SIMS observation. This technique can also be applied to other mass spectrometry methods such as MALDI observations for detecting sample molecules on a substrate. The electrodes to be used for the observation should be made to match the analyzer (type of mass spectrometry) in terms of shape and arrangement. For instance, the intensity of the electric field to be applied, the distances between the sample and the electrode and the shape of the proton-control electrode should be adjusted so as to make them match the energy level of protons emitted from the analyzer. Furthermore, ions of sample molecules carrying protons adhering thereto can be detected more efficiently by devising an appropriate shape for the proton-control electrode 19. For example, the generated electric field can be applied to the proton emission point on the sample surface in a concentrated manner when the proton-control electrode 19 has a parabolic or ring-shaped profile. Then, as a result, flying protons 16 can be made to collide with neutral sample molecules 18 more efficiently.

An AC voltage may alternatively be applied between the proton-control electrode 19 and the substrate 13. Then, protons 16 can be captured and held above the sample surface so that flying protons 16 can be made to collide with neutral sample molecules 18 more efficiently by generating an AC electric field in the axial direction that is axially symmetric with the primary beam axis.

Particularly, the probability of collisions of flying protons 16 and neutral sample molecules 18 can be expected to increase when a high frequency AC voltage is employed. Thus, the use of a high frequency AC voltage will give rise to a certain effect of improving the sensitivity of detecting ions of sample molecules carrying protons adhering thereto. In view of the flying speed and the behaviors of protons 16 that are observed in the above-described experiments, the frequency of the AC voltage to be used is preferably within a range between 0.1 and 10 MHz.

Thanks to the present invention, the probability of making protons adhere to sample molecules can be improved without requiring a large facility for supplying ions so that sample molecules on a substrate can be detected highly sensitively. The efficiency of making protons adhere to sample molecules can be improved by arranging the proton-control electrode on the axis that is axially symmetric with the primary beam axis relative with regard to the central axis when compared with an instance of applying an electric field in the direction perpendicular to the substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-091468, filed Apr. 12, 2010, which is hereby incorporated by reference herein in its entirety.

What is claimed is:

1. An information acquiring apparatus for acquiring information relating to the mass of a constituent of an object on a substrate by means of mass spectrometry, the apparatus comprising:

a mechanism for converging and pulsing a primary beam selected from an ion beam, a neutral particle beam and a laser beam and irradiating the converged and pulsed primary beam onto the object on the substrate;

a control electrode arranged in a conical region for applying a backward force to flying charged particles generated by the irradiation of the primary beam, the conical region having a vertex at a central point and a rotation axis disposed in axial symmetry with a primary beam axis with regard to a central axis and diverging from the vertex with an angle of 30° relative to the rotation axis, where the primary beam axis is a trajectory of the primary beam, the central point is a point of intersection of the trajectory of the primary beam and a surface of the object, and the central axis passes the central point and is disposed normal to the substrate; and an extraction electrode arranged above the substrate for mass spectrometry, wherein the control electrode is configured to generate an electric field for applying the backward force in a direction generally parallel to the rotation axis.

2. The apparatus according to claim 1, wherein the apparatus further comprises a mechanism for controlling a timing of pulsing the primary beam, a timing of applying a voltage to the control electrode, and a timing of applying a voltage to the extraction electrode.

3. The apparatus according to claim 1, wherein the control electrode is arranged on the rotation axis disposed in axial symmetry with the primary beam axis with regard to the central axis.

4. The apparatus according to claim 1, wherein the control electrode is flat-panel-shaped, parabola-shaped or ring-shaped.

5. The apparatus according to claim 1, wherein a DC voltage or an AC voltage with a frequency within a range between 0.1 and 10 MHz is applied to the control electrode such that an electric field having an intensity within a range between 1 kV/m and 20 kV/m as an average absolute value is generated between the control electrode and the object.

6. The apparatus according to claim 2, wherein the timing of applying a voltage to the extraction electrode is controlled to be between 0.1 μsec and 20 μsec after the primary beam gets to the object.

7. The apparatus according to claim 2, wherein a voltage is applied to the control electrode simultaneously with or after the primary beam gets to the object and subsequently a voltage is applied to the extraction electrode.

8. The apparatus according to claim 1, wherein the constituent is a protein, a peptide, a sugar chain, a polynucleotide or an oligonucleotide.

9. An information acquiring method for acquiring information relating to the mass of a constituent of an object on a substrate by means of mass spectrometry, the method comprising steps of:

converging and pulsing a primary beam selected from an ion beam, a neutral particle beam and a laser beam and irradiating the converged and pulsed primary beam onto the object on the substrate to drive neutral molecules of the constituent and charged particles to fly;

applying a voltage to a control electrode to apply a backward force toward the object on the substrate to flying charged particles simultaneously with or after the irradiation of the converged and pulsed primary beam to make the flying charged particles adhere to flying neutral molecules of the constituent; and applying a voltage to the extraction electrode after applying a voltage to the control electrode to detect neutral molecules of the constituent with charged particles adhering thereto by means of a mass spectrometer to acquire mass information, the control electrode being arranged in a conical region, the conical region having a vertex at a central point and a rotation axis disposed in axial symmetry with a primary beam axis with regard to a central axis and diverging from the vertex with an angle of 30° relative to the rotation axis, where the primary beam axis is a trajectory of the primary beam, the central point is a point of intersection of the trajectory of the primary beam and a surface of the object, and the central axis passes the central point and is disposed normal to the substrate, wherein the control electrode is configured to generate an electric field for applying the backward force in a direction generally parallel to the rotation axis.

10. The method according to claim 9, wherein a DC voltage for applying a backward force to flying charged particles generated by the irradiation of the primary beam or an AC voltage with a frequency within a range between 0.1 and 10 MHz is applied to the control electrode such that an electric field having an intensity within a range between 1 kV/m and 20 kV/m as an average absolute value is generated between the control electrode and the object.

11. The method according to claim 9, wherein a timing of applying a voltage to the extraction electrode after applying a voltage to the control electrode is controlled to be between 0.1 μsec and 20 μsec after the primary beam gets to the object.

* * * * *